US006814058B2

(12) United States Patent
Oono

(10) Patent No.: US 6,814,058 B2
(45) Date of Patent: Nov. 9, 2004

(54) CHARACTERISTIC CORRECTION SYSTEM FOR A FUEL PRESSURE SENSOR

(75) Inventor: Takahiko Oono, Hyogo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 64 days.

(21) Appl. No.: 10/288,527

(22) Filed: Nov. 6, 2002

(65) Prior Publication Data

US 2004/0007213 A1 Jan. 15, 2004

(30) Foreign Application Priority Data

Jul. 10, 2002 (JP) ..... 2002-201342

(51) Int. Cl.[7] ..... F02M 33/04
(52) U.S. Cl. ..... 123/458; 123/494
(58) Field of Search ..... 123/458, 494, 123/506, 295; 73/116, 119 A

(56) References Cited

U.S. PATENT DOCUMENTS 5,313,924 A * 5/1994 Regueiro ..... 123/456
5,423,302 A * 6/1995 Glassey ..... 123/446
5,848,583 A * 12/1998 Smith et al. ..... 123/497
6,047,682 A * 4/2000 Fujino et al. ..... 123/458
6,314,945 B1 * 11/2001 Sugiyama et al. ..... 123/506
6,526,947 B2 * 3/2003 Shimada et al. ..... 123/495

FOREIGN PATENT DOCUMENTS

JP 10-009073 1/1998
JP 10-037789 10/1998

* cited by examiner

*Primary Examiner*—Thomas Moulis
(74) *Attorney, Agent, or Firm*—Sughrue Mion, PLLC

(57) ABSTRACT

Characteristic correction system for a fuel pressure sensor includes a high-pressure fuel pump 14 for discharging a high-pressure fuel, a high-pressure fuel pipe 15 for accumulating/pressurizing the high-pressure fuel, a fuel pressure control valve 16 for adjusting a fuel pressure of the high-pressure fuel to a given value, a fuel injection valve 2 for directly injecting into the combustion chamber 3 a high-pressure fuel, a pressure release valve 2, 16 for equalizing an internal pressure of the pipe 15, a fuel pressure sensor 18 for detecting the pipe's internal pressure, and a control unit 17 for calculating a correction value for a detected value, based on a pressure differential between the pipe's internal pressure and a known gas pressure, when the pipe's internal pressure is equalized with the known gas pressure.

11 Claims, 9 Drawing Sheets

CHARACTERISTIC CORRECTION SYSTEM FOR A FUEL PRESSURE SENSOR

BACKGROUND OF THE INVENTION

1. Field of the Invention

The present invention relates to a characteristic correction system for a fuel pressure sensor in an in-cylinder injection-type internal combustion engine that directly injects fuel that has been accumulated/pressurized in a high-pressure fuel pipe into a combustion chamber, wherein the characteristic correction system for a fuel pressure sensor corrects a fuel pressure sensor characteristic used to adjust a correction of a fuel injection amount, and to adjust the fuel pressure in the high-pressure fuel pipe.

2. Description of the Related Art

In recent years, there has been used an in-cylinder injection-type internal combustion engine, in which an injection hole of a fuel injection valve is mounted facing in the combustion chamber, and fuel is directly injected into the combustion chamber by means of the fuel injection valve.

This type of internal combustion engine is composed of a low-pressure fuel pump, a high-pressure fuel pump, a low-pressure regulator, a high-pressure fuel pipe, a fuel pressure control valve and a fuel injection valve.

The low-pressure fuel pump sucks up the fuel from the fuel tank and discharges the relatively low-pressure fuel. The high-pressure fuel pump sucks up the low-pressure fuel discharged by the low-pressure fuel pump, and discharges relatively high-pressure fuel.

When the discharge pressure from the low-pressure fuel pump has risen sufficiently, the low-pressure regulator adjusts the fuel pressure to a low-pressure set value, and the high-pressure fuel pipe accumulates/pressurizes the high-pressure fuel that the high-pressure fuel pump discharges.

The fuel pressure control valve adjusts the pressure of the fuel that is accumulated/pressurized in the high-pressure fuel pipe to a given value, and the fuel injection valve injects into the combustion chamber the high-pressure fuel which has been adjusted by the fuel pressure control valve.

Further, the internal combustion engine is provided with a fuel pressure sensor for detecting the pressure of the fuel that is accumulated/pressurized in the high-pressure fuel pipe. By performing a feedback control on the fuel pressure control valve so that the correction of the injected fuel amount and the fuel pressure in the high-pressure fuel pipe respectively take a given value, the combustion state and the operating state in the internal combustion engine are optimally controlled.

Thus, in order to achieve the object of optimally controlling the combustion state and the operating state of the internal combustion engine, it is extremely important to maintain the detection precision of the fuel pressure sensor. Therefore, various techniques for compensating the detection precision have been proposed.

For example, JP 10-9073 A proposes a method in which, when the discharge pressure of the low-pressure fuel pump rises sufficiently and the high-pressure fuel pump is substantially in a non-drive state, a detected value from the fuel pressure sensor is corrected so as to correspond with the low-pressure set value that is adjusted by the low-pressure regulator.

Also, JP 10-37789 A proposes a method comprising two fuel pressure sensors each having detection ranges with different sizes, in which the detected values from the two fuel pressure sensors are compared to each other to correct the detected values from the fuel pressure sensors.

The conventional fuel pressure characteristic correction system is as described above. Namely, in the correction method proposed in JP 10-9073 A, no consideration is given for variation in the adjustment pressure and in the discharge flow rate due to manufacturing tolerance and deterioration of the low-pressure regulator and the high-pressure fuel pump, nor is consideration given for deterioration of the detection precision due to manufacturing tolerance and deterioration of the fuel pressure sensor. Therefore, there is a danger that the low-pressure set value itself, which is used as a reference pressure when correcting the fuel pressure sensor, is off mark. Thus, when the fuel pressure sensor is corrected while the low-pressure set value is off mark, the correction ultimately becomes an erroneous correction, and there was a problem in that the precision of the fuel injection amount and the controllability of the fuel pressure adjustment would deteriorate.

Further, the correction method proposed in JP 10-37789 A requires multiple fuel pressure sensors, and there was a problem in that it became too expensive. Further, compared to the fuel pressure sensor with the larger detection range, the detection member of the fuel pressure sensor with the smaller detection range always exhibits a greater amount of distortion. Therefore, there was a problem in that its durability might decrease.

SUMMARY OF THE INVENTION

The present invention has been made to solve problems such as those mentioned above, and therefore has as an object to obtain a characteristic correction system for a fuel pressure sensor, which compensates the detection characteristic of the fuel pressure sensor to a high precision level, from the beginning through aged deterioration.

The characteristic correction system for a fuel pressure sensor according to the present invention includes a high-pressure fuel pump for sucking up low-pressure fuel pumped out from a fuel tank and discharging a high-pressure fuel, a high-pressure fuel pipe for accumulating/pressurizing the high-pressure fuel, a fuel pressure control valve for adjusting a fuel pressure of the high-pressure fuel to a given value, a fuel injection valve for directly injecting into the combustion chamber a high-pressure fuel which has been adjusted by the fuel pressure control valve, pressure release valve for equalizing a pressure in the high-pressure fuel pipe at a known gas pressure. And further includes a fuel pressure sensor for detecting the pressure in the pipe, and a control unit for calculating a correction value for a detected value from the fuel pressure sensor, based on a pressure differential between the pressure in the pipe and the gas pressure, wherein the control unit opens the pressure release valve, and when the pressure in the pipe becomes equal to the gas pressure, the gas pressure is used as a reference value to calculate the correction value.

Therefore, it becomes possible to easily and precisely perform the correction in light of the deterioration in the detection precision level arising from the manufacturing tolerance and the deterioration of the fuel pressure sensor and the like.

Further, the characteristic correction system for a fuel pressure sensor according to the present invention includes a high-pressure fuel pump for sucking up low-pressure fuel pumped out from a fuel tank and discharging a high-pressure fuel, a high-pressure fuel pipe for accumulating/pressurizing the high-pressure fuel, a fuel pressure control valve for adjusting a fuel pressure of the high-pressure fuel to a given value, a fuel injection valve for directly injecting into the combustion chamber a high-pressure fuel which has been adjusted by the fuel pressure control valve. And further includes a fuel pressure sensor for detecting a pressure in the high-pressure fuel pipe, and a control unit for calculating a correction value for a detected value from the fuel pressure sensor, based on a pressure differential between the pressure in the pipe and the gas pressure, wherein the control unit calculates the correction value in a case where the detected value is equal to or less than a pressure of atmospheric pressure.

Therefore, in the range of characteristic variation exhibited in the fuel pressure sensor, when the detected value from the fuel pressure sensor indicates a negative pressure that is equal to or less than the atmospheric pressure and which is not actually possible, this detected value is immediately corrected to a characteristic that is within the range that is actually possible.

DETAILED DESCRIPTION OF THE PREFERRED EMBODIMENTS

Embodiment 1

Hereinafter, a detailed explanation of Embodiment 1 of the present invention will be made with reference to the diagrams.

Figure 1:
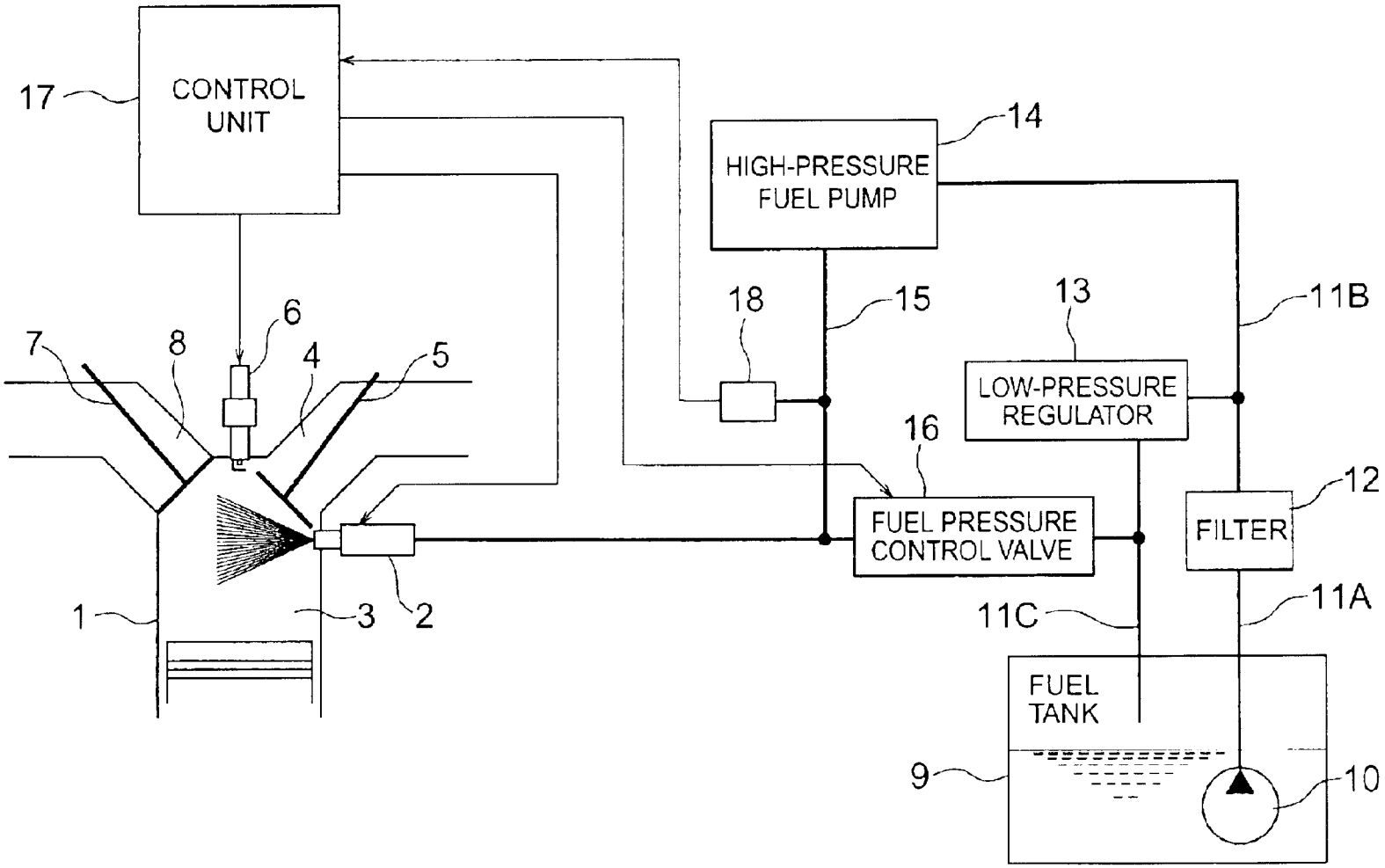
FIG. 1 is a constructional diagram illustrating an overall system according to Embodiment 1 of the present invention.

FIG. 1 is a constructional diagram illustrating an overall system according to Embodiment 1 of the present invention.

In FIG. 1, an internal combustion engine 1 is an in-cylinder-type spark ignition engine, and a fuel injection valve 2 is arranged so that an injection hole thereof is facing in a combustion engine 3. The fuel injection valve 2 discharges fuel onto new air which is sucked into the combustion chamber 3 via an air intake port 4 and an air intake valve 5, to form an air-fuel mixture, and to ignite this by means of a spark ignition by a spark plug 6.

Exhaust from the internal combustion engine 1 is expelled by opening an exhaust valve 7 to communicate the combustion chamber 3 and an exhaust port 8, and the exhaust is sent through an exhaust cleansing catalyst (not shown in the diagram) and through a muffler (not shown in the diagram) out to the atmosphere.

Further, the fuel in the fuel tank 9 is discharged as relatively low pressure fuel into a low-pressure fuel pipe 11A by an electronically-driven low-pressure fuel pump 10, and it is filtered by a filter 12.

After that, the fuel, which has had its fuel pressure adjusted to the given low-pressure set value (for example, 0.3 MPa) by a low-pressure regulator 13 that is provided so as to bypass to a low-pressure-side fuel pipe 11B on a downstream side of the filter 12, is sent to a high-pressure fuel pump 14.

The high-pressure fuel pump 14 is driven by a crank shaft and a cam shaft of the internal combustion engine 1, either directly or indirectly via a gear and a belt, and the low-pressure fuel in the low-pressure fuel pipe 11B is pressurized to a high pressure and discharged out into a high-pressure fuel pipe 15.

The fuel which has been discharged from the high-pressure fuel pump 14 is controlled to a given high-pressure set value by a fuel pressure control valve 16, which is provided so as to bypass to the high-pressure fuel pipe 15.

Further, into a control unit 17 there are inputted signals from a variety of sensors (not shown in the diagram) for detecting the operating state of the internal combustion engine 1, and a pulse width of an injection pulse signal for controlling the fuel injection valve 2 is controlled, and moreover, an output start timing of the injection pulse, which is to say a fuel injection period of the fuel injection valve 2, is controlled.

Further, the control unit 17 performs a feedback control on the combustion valve 16 such that the fuel pressure in the high-pressure fuel pipe 15 which was detected by the fuel pressure sensor 18 is aligned with a target fuel pressure which corresponds to the operating state of the internal combustion engine 1.

Specifically, in a case where the fuel pressure in the high-pressure fuel pipe 15 detected by the fuel pressure sensor 18 is lower than the target fuel pressure, control is performed to close the combustion valve 16, raise the pressure in the high-pressure fuel pipe 15, and align the pressure with the target pressure.

Conversely, in a case where the fuel pressure in the high-pressure fuel pipe 15 detected by the fuel pressure sensor 18 is higher than the target pressure, control is performed to close the fuel pressure control valve 16 and return a portion of the fuel accumulated/pressurized in the high-pressure fuel pipe 15 back to the fuel tank 9 via the low-pressure fuel pump (return pipe) 11C, to thereby lower the pressure in the high-pressure fuel pipe 15, so that it aligns with the target pressure.

Further, the control unit 17 stores the correction value correcting the error in the detected value from the fuel pressure sensor 18, and, in the control or the internal combustion engine 1, the control unit 17 uses a value produced by reflecting the correction value in the detected value from the fuel pressure sensor 18.

Figure 2:
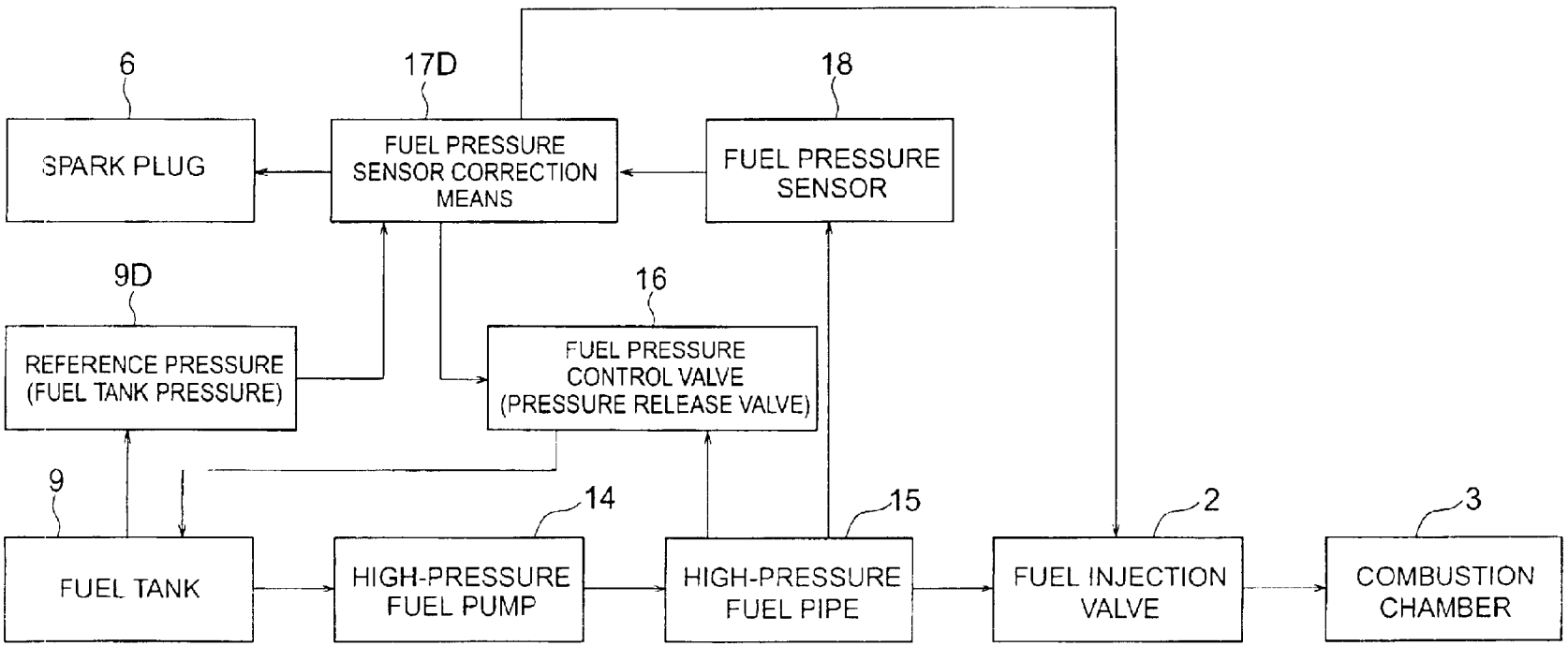
FIG. 2 is a block diagram explaining operation according to Embodiment 1 of the present invention.

Thus, in FIG. 2, the fuel that is pumped from the fuel tank 9 is pressurized by the high-pressure fuel pump 14 and discharged to the high-pressure fuel pipe 15. The fuel pressure in the high-pressure fuel pipe 15 is controlled at the given value by means of the fuel pressure control valve 16 opening and by the fuel returning back to the fuel tank 9. The fuel which has had its fuel pressure controlled is injected into the combustion chamber 3 by the fuel injection valve 2.

On the other hand, the fuel pressure in the high-pressure fuel pipe 15 is detected by the fuel pressure sensor 18 and this is notified to the control unit 17. Fuel pressure sensor correction means 17D in the control unit 17 calculates the correction value for the detected value from the fuel pressure sensor 18 by using the pressure in the fuel tank 9 as the reference pressure (9D).

The control unit 17 reflects the correction value that was produced by the fuel pressure sensor correction means 17D into the detected value from the fuel pressure sensor 18. The control unit 17 also calculates control amounts for the fuel injection valve 2, the spark plug 6, the fuel pressure control valve 16 and other various actuators, and performs controls based on the calculated control amounts.

Figure 3:
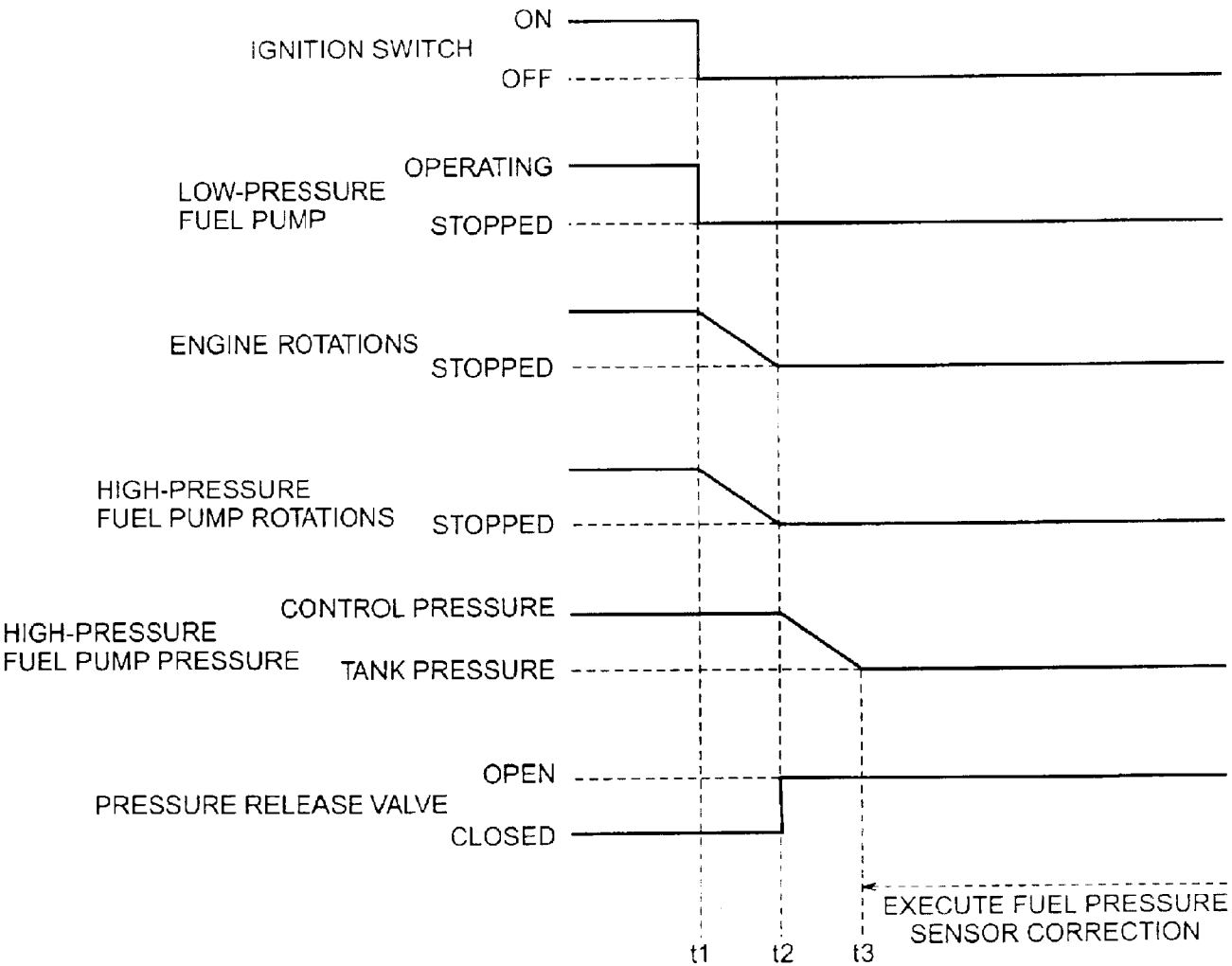
FIG. 3 is a time chart showing operation according to Embodiment 1 of the present invention.

Next, an explanation will be made regarding operation according to Embodiment 1 of the present invention. FIG. 3 is a time chart showing operation according to Embodiment 1 of the present invention.

While the internal combustion engine is rotating (before time t1), the ignition switch is ON, the low pressure fuel pump 10 is operating, and the internal combustion engine 1 and the high-pressure fuel pipe 14 are rotating. Further, the pressure in the high-pressure fuel pipe 15 is being adjusted to the given target fuel pressure (control pressure) by the fuel pressure control valve 16.

Further, the fuel that has been adjusted to the given target fuel pressure is injected into the combustion chamber 3 by the fuel injection valve 2.

Next, at time t2, when the ignition switch changes from ON to OFF, the low-pressure fuel pump 10 stops and the internal combustion engine stops (time t1 to t2) since the control unit 17 stops the control of the internal combustion engine 1.

Further, since the high-pressure fuel pipe 14 is driven by the crank shaft and the cam shaft of the internal combustion engine 1 either directly or indirectly via the gear and the belt, the pump 14 stops when the internal combustion engine 1 stops. At this point in time, since the high-pressure fuel pipe 15 has been changed to a closed state by, for example, the fuel pressure control valve 16 or other such pressure release valve, it is kept in the high-pressure state of before time t1.

In this high-pressure state, at time t2, when a pressure release valve (for example, the fuel pressure control valve 16) that is between the fuel tank 9 and the high-pressure fuel pipe 15 is opened, the high-pressure fuel accumulated/pressurized in the high-pressure fuel pipe 15 travels along the return pipe 11C to return back to the fuel tank 9.

Once the pressure release valve is opened, after at least a response time (times t2 to t3) for the pressure in the high-pressure fuel pipe 15, the pressure in the high-pressure fuel pipe 15 and the pressure in the fuel tank 9 are equalized with each other.

The fuel pressure sensor correction means 17D stored in the control unit 17 uses the internal pressure of the fuel tank 9 when the pressures in the high-pressure fuel pipe 15 and in the fuel tank 9 are in a stable and equal state (after time t3) as the reference pressure (9D), to calculate a correction value for the characteristic of the fuel pressure sensor 18, and this is stored in a memory built into the control unit 17.

Note that, since it is sufficient if the pressure release valve is between the fuel tank 9 and the high-pressure fuel pipe 15 and is an electromagnetic valve with a function of communicating/severing the fuel tank 9 and the high-pressure fuel pipe 15, the fuel pressure control valve 16 may be a pressure release valve as shown in FIG. 1 to achieve this function.

Further, for the reference pressure for correcting the fuel pressure sensor 18, it is desirable to use the detected value from a tank internal pressure sensor (not shown in the diagram) which directly detects pressure in the fuel tank 9. However, it is also possible to use an estimated value calculated by the control unit 17, or an approximate value determined in advance.

Figure 4:
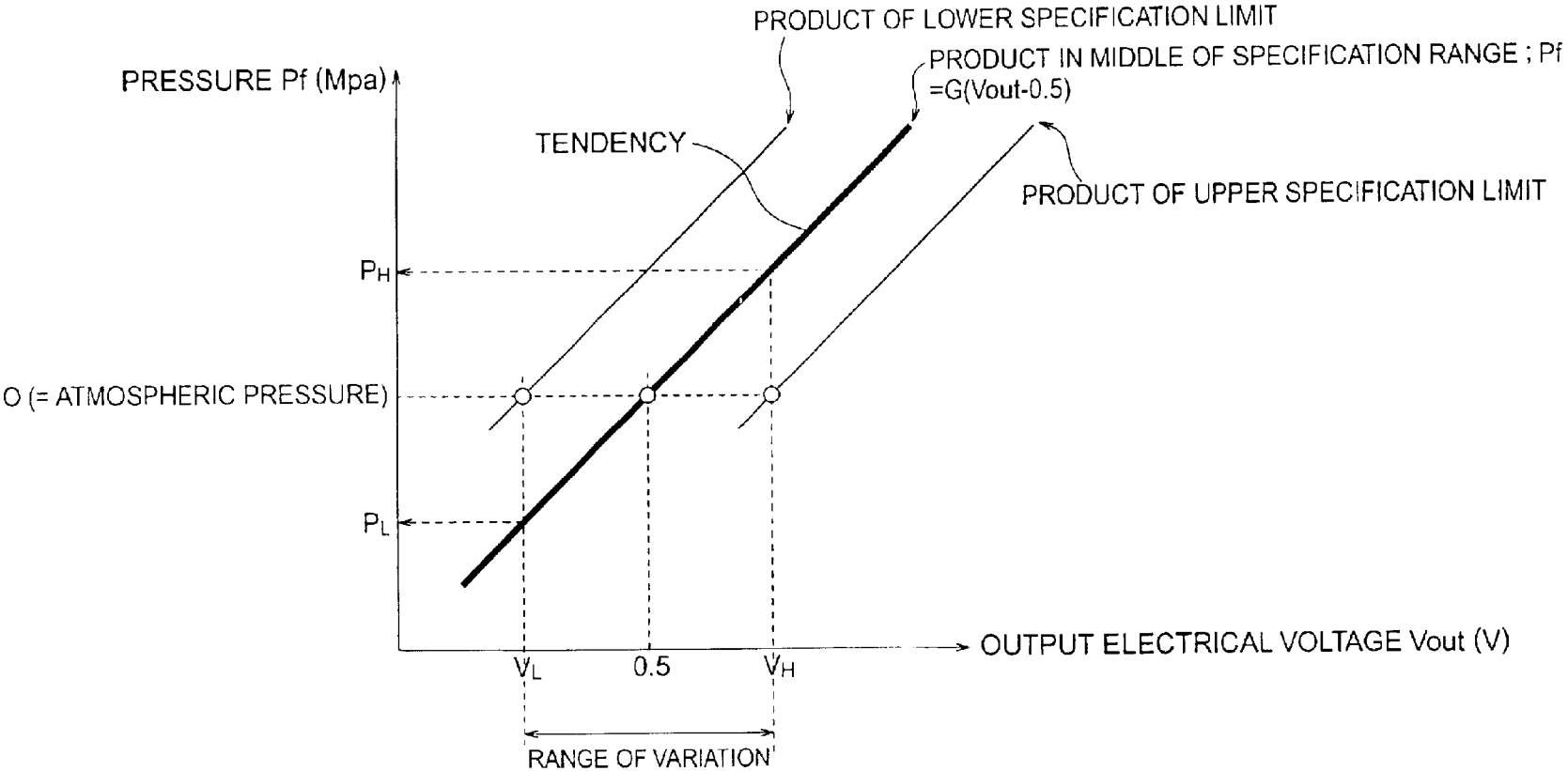
FIG. 4 is a characteristic diagram illustrating a relationship between a pressure Pf applied to a fuel pressure sensor, and an output electrical voltage Vout.

Next, an explanation will be made regarding a characteristic of the fuel pressure sensor 18. FIG. 4 is a characteristic diagram showing a relationship between a pressure Pf applied to the fuel pressure sensor 18, and an output electrical voltage Vout.

In FIG. 4, the pressure Pf applied to the fuel pressure sensor 18 is indicated by a vertical axis, and the output electrical voltage Vout is indicated by a horizontal axis. A standard characteristic for the fuel pressure sensor 18 is indicated by the graph of a product having mid-range characteristics. This is specified such that when an inclination of G (Mpa/V) is exhibited, output Vout=0.5V when pressure Pf=0 Mpa (=atmospheric pressure). This is expressed by the following formula (1).

$$\text{Detected pressure: } Pf = G \times (Vout - 0.5) \quad (1)$$

Incidentally, due to manufacturing tolerance and deterioration, it is considered that the characteristic of the fuel pressure sensor 18 will exhibit variation between a product of the upper specification limit and a product of the lower specification limit. For example, even when an atmospheric pressure of 0 Mpa is applied to the fuel pressure sensor 18, the output electrical voltage Vout varies within a range of $VL \leqq Vout \leqq VH$.

If the fuel pressure sensor 18 is changed to the characteristic of the product of the upper specification limit, even if the atmospheric pressure is applied as the reference pressure, "VH" will be outputted as the value of the output electrical voltage Vout from the fuel pressure sensor 18. Thus, for the detected pressure Pf, "PH" is shown as the value that was detected.

Further, if the fuel pressure sensor 18 is changed to the characteristics of the product of the lower specification limit, even if the atmospheric pressure is applied as the reference pressure, "VL" will be outputted as the value of the output electrical voltage Vout. Thus, for the detected pressure Pf, "PL" is shown as the value that was detected.

Therefore, when the detected pressure Pf is calculated according to the formula (1), the detected voltage Pf varies within the range of $PL \leqq Pout \leqq PH$.

In order to correct this offset error from the fuel pressure sensor 18, a correction coefficient K is calculated by means of a formula (2), and a formula (3) using the correction coefficient K is used to calculate the detected pressure Pf, thus enabling correction of the fuel pressure sensor characteristic.

$$\text{Correction coefficient: } K = Pref - Pout \quad (2)$$

$$\text{Detected pressure: } Pf = G \times (Vout - 0.5) - K \quad (3)$$

The characteristic of the fuel pressure sensor 18 should vary within the range between the upper and lower specification limits, and if it varies from the reference pressure out of the upper or lower specification limits, it is considered that there is some abnormality in the system.

There is a danger of an erroneous correction occurring in the state described above, but the erroneous correction can be prevented by correcting the fuel pressure sensor characteristic only when the detected value from the fuel pressure sensor 18 is within a given range between the upper and lower specification limits.

As described above, a gas whose pressure is known is used as the reference pressure to correct the fuel pressure sensor characteristic, whereby a stable reference pressure that is not influenced by variation in the parts, such as from the manufacturing tolerance or from the deterioration in the low-pressure regulator 13 or in the high-pressure fuel pump 14, can be used to correct the fuel pressure sensor characteristic, and a correct fuel pressure can be produced.

Figure 5:
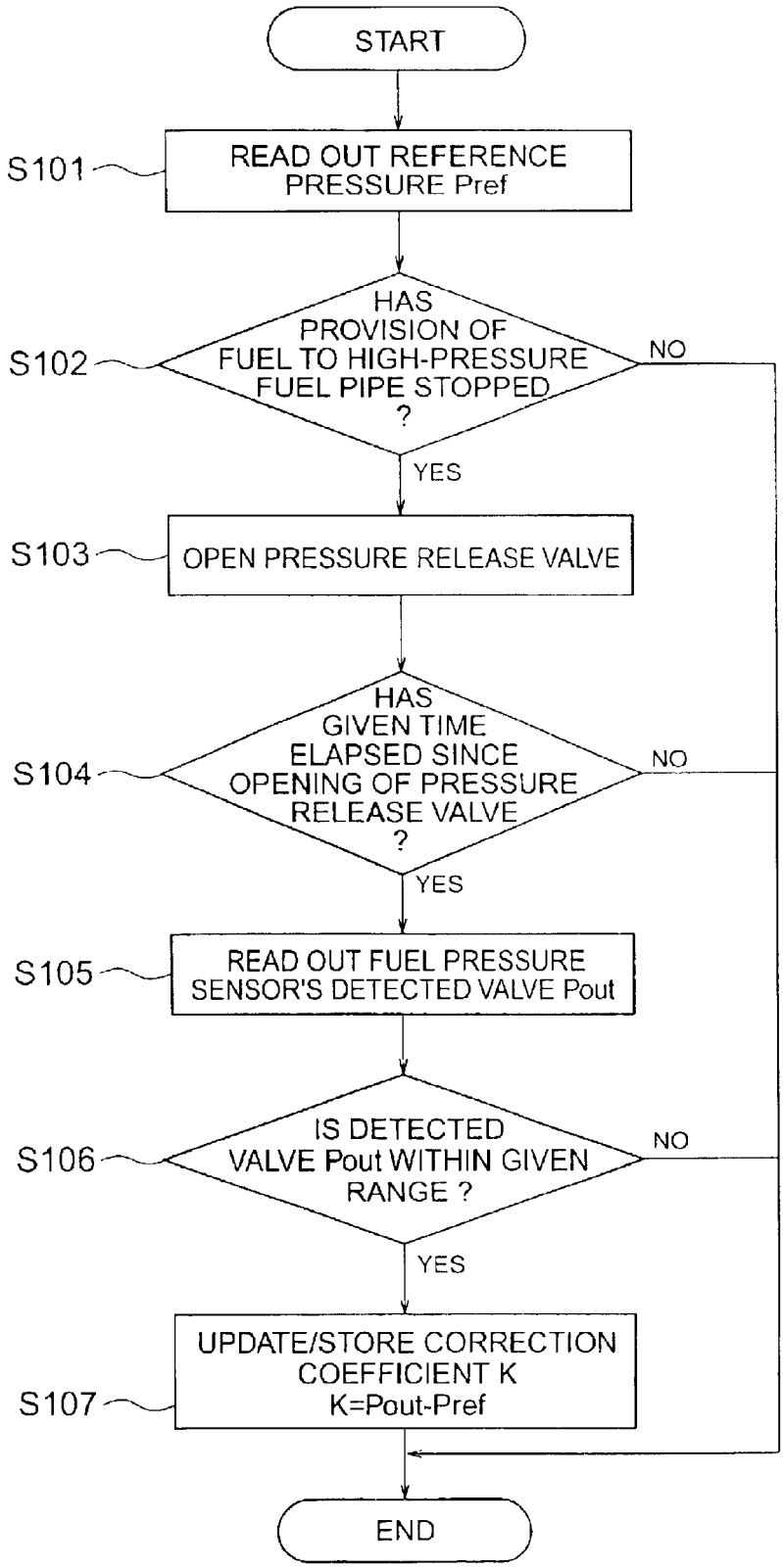
FIG. 5 is a flow chart illustrating operation of fuel pressure sensor correction means stored in a control unit according to Embodiment 1 of the present invention.

Next, an explanation will be made regarding operation of the fuel pressure sensor correction means 17D according to Embodiment 1 of the present invention. FIG. 5 is a flow chart showing operation of the fuel pressure sensor correction means 17D stored in the control unit 17 according to Embodiment 1 of the present invention.

First, the reference pressure Pref is read (at this point, it is temporarily assumed that 0 Mpa=atmospheric pressure, and 0 Mpa is read) (step S101), and a determination is made as to whether or not the supply of fuel to the high-pressure fuel pipe 15 has stopped (i.e., whether or not the high-pressure fuel pump 14 has stopped) (step S102).

At step S102, in the case where the supply of the fuel to the high-pressure fuel pipe 15 has stopped (i.e., YES), the pressure release valve is opened (step S103). Further, in the case where the supply of the fuel to the high-pressure fuel pipe 15 is not stopped (i.e., NO), the procedure skips steps S103 to S107, and the processing routine in FIG. 5 ends.

Next, it is determined whether or not a given amount of time has elapsed since the pressure release valve was opened (step S104).

At step S104, in the case where the given amount of time has elapsed since the pressure release valve was opened (i.e., YES), the detected value Pout of the fuel pressure sensor 18 is read (step S105). In the case where the given amount of time has not elapsed since the pressure release valve was opened (i.e., NO), the procedure skips steps S105 to S107, and the processing routine of FIG. 5 ends.

Next, it is determined whether or not the detected value Pout of the fuel pressure sensor 18 which was read at step S105 is within the given range ($PL \leqq Pout \leqq PH$) (step S106).

At step S106, in the case where the detected value Pout of the fuel pressure sensor 18 is within the given range (i.e., YES), the procedure advances to step S107. In the case where it is not within the given range (i.e., NO), the procedure skips step S107 and the processing routine in FIG. 5 ends.

Next, the formula (2) is used to calculate a difference between the reference pressure Pref and the detected value Pout from the fuel pressure sensor 18 as a correction differential K for the fuel pressure sensor 18. This updates a correction coefficient K in the memory of the control unit 17, and is stored in the memory. Then, the processing routine in FIG. 5 ends.

After that, using the formula (3), the control unit 17 uses the correction coefficient K stored in the memory to correct the detected value from the fuel pressure sensor 18.

Note that, when a battery is connected to the control unit 17 for the first time, the correction coefficient K is set to "0" as an initial value. After that, the updating is performed by the present processing routine, and the value that is stored by the present processing routine is used until the battery is removed from the control unit 17.

As described above, since the gas whose pressure is known is used as the reference pressure to correct the characteristic of the fuel pressure sensor 18, it becomes possible to easily and accurately achieve the correction which takes into consideration the deterioration of the detection precision caused by the manufacturing tolerance and by the deterioration in the fuel pressure sensor 18 and the like.

Further, since the fuel which has flowed out from the high-pressure fuel pipe 15 due to the opening of the pressure release valve is returned back to the fuel tank 9, a system construction having extremely high stability becomes possible.

Further, since the pressure in the high-pressure fuel pipe 15 quickly becomes equal with the fuel tank's internal pressure simultaneously with the opening of the pressure release valve, and since the characteristic of the fuel pressure sensor 18 is corrected after the supply of fuel to the high-pressure fuel pipe 15 is stopped, the fuel pressure sensor 18 characteristic correction can be carried out quickly.

The fuel pressure in the high-pressure fuel pipe 15 drops quickly due to the opening of the pressure release valve, but, after opening the pressure release valve, the characteristic of the fuel pressure sensor 18 is corrected after at least a given amount of time corresponding to the pressure response time that is necessary to sufficiently equalize the pressure in the high-pressure fuel pipe 15 and the internal pressure of the fuel tank. Therefore, the erroneous correction of the fuel pressure sensor characteristic can be prevented.

The fuel pressure sensor 18 is generally one which detects physical transformations of a diaphragm which receives the pressure. Variation exhibited by such a fuel pressure sensor 18 is mainly offset errors, which have extremely good linearity. Thus, it is possible to correct the detected value when the known pressure is used as the reference pressure.

Therefore, the characteristic of the fuel pressure sensor is corrected when the detected value from the fuel pressure sensor 18 at the time when the pressure in the high-pressure fuel pipe 15 and the reference pressure are equal, is within the given range determined based on the range of variation exhibited by the reference pressure and based on the fuel pressure sensor 18, to thereby prevent the erroneous correction within the given range.

Embodiment 2

Note that, in Embodiment 1, the fuel pressure control valve 16 was used as the pressure release valve. However, it is also possible to use the fuel injection valve 2 as the pressure release valve.

Figure 6:
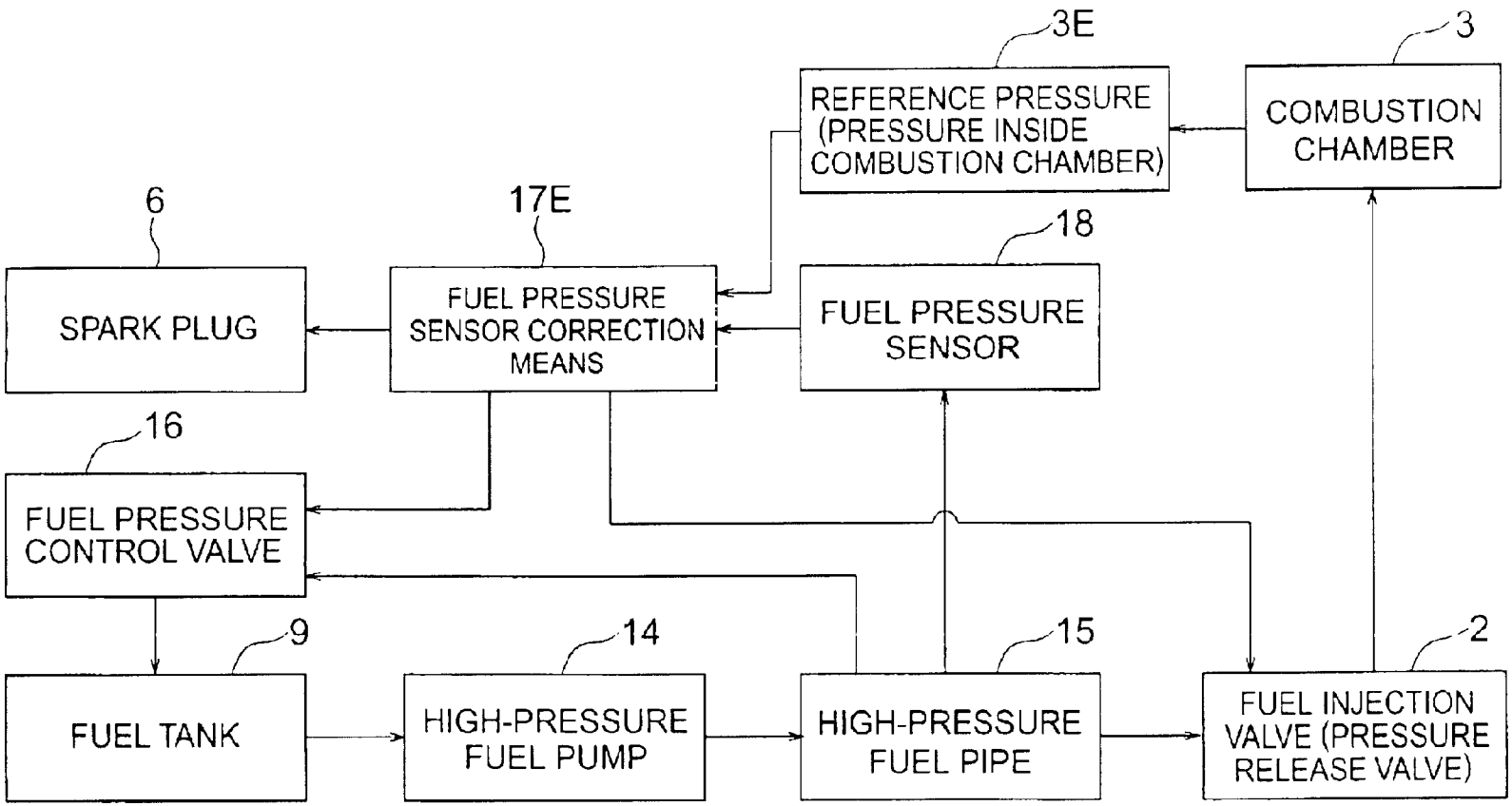
FIG. 6 is a block diagram explaining operation according to Embodiment 2 of the present invention.

FIG. 6 is a block diagram for explaining operation according to Embodiment 2 of the present invention. Note that, in FIG. 6, elements which are similar to those stated above (see FIG. 2) are indicated by the same reference numerals, or an "E" is appended after the same reference numerals, and detailed explanations thereof are omitted.

When the internal combustion engine 1 is started and the air intake valve 5 is open, the pressure in the combustion chamber 3 is generally equal to atmospheric pressure. Further, when started, the engine is low in R.P.M., and the discharge rate of the high-pressure fuel pump also decreases. Therefore, the rise of the fuel pressure is slow, and it is necessary to lengthen the amount of time that the fuel injection valve 2 is open.

When the amount of time that the fuel injection valve 2 is open is lengthened, the amount of fuel supplied to the high-pressure fuel pipe 15 from the high-pressure fuel pump 14 cannot keep up with the injection fuel amount from the fuel injection valve 2. Thus, the fuel pressure in the high-pressure fuel pipe 15 declines, and, ultimately, it becomes equal to the atmospheric pressure which is the internal pressure (3E) in the combustion chamber.

Fuel pressure sensor correction means 17E uses the atmospheric pressure, which is the internal pressure of the combustion chamber (3E) in the above-mentioned engine state, as the reference pressure, to correct the characteristic of the fuel pressure sensor 18. Thus, the fuel injection valve 2 provided in the in-cylinder injection-type internal combustion engine 1 can be used as the pressure release valve just as it is.

Figure 7:
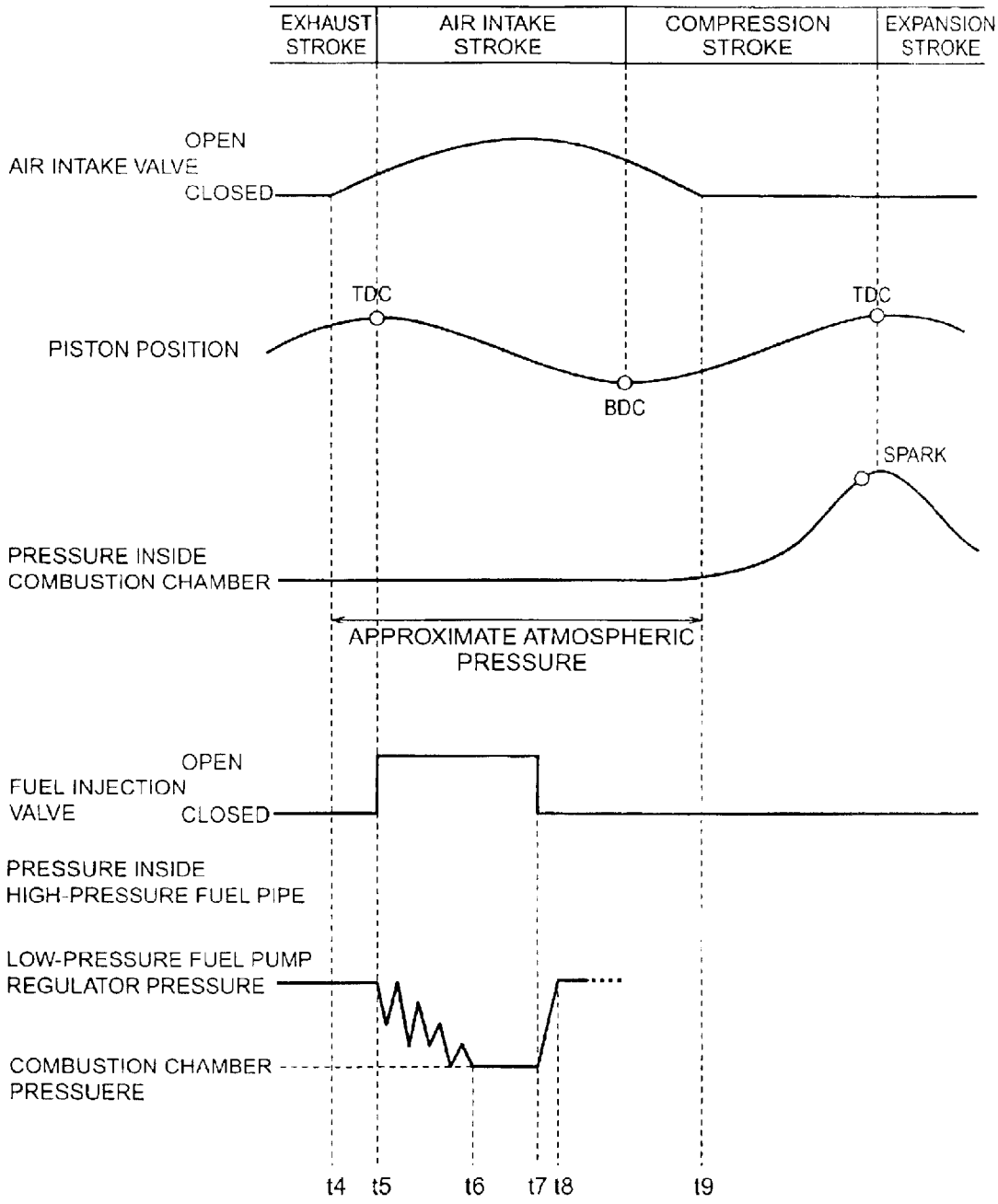
FIG. 7 is a time chart illustrating operation in accordance with Embodiment 2 of the present invention.

Next, an explanation will be made regarding an operation according to Embodiment 2 of the present invention in connection with a gas exchange stroke of the internal combustion engine 1. FIG. 7 is a time chart showing the operation according to Embodiment 2 of the present invention.

In FIG. 7, while the air intake valve 5 is open (times t4 to t9) when the internal combustion engine 1 is starting, the combustion chamber 3 and the air intake pipe 4 are communicated with each other. Therefore, regardless of the piston position, the pressure in the combustion chamber 3 substantially converges upon the atmospheric pressure.

In this state, since the fuel pressure in the high-pressure fuel pipe 15 is still at the regulator pressure (i.e., low pressure) of the low-pressure fuel pump 10, and since the friction in the internal combustion engine 1 is great, much fuel is needed and the amount of time that the fuel injection valve 2 is open becomes longer than in the normal engine operating state (times t5 to t7).

Thus, when the high-pressure fuel pipe 15 is in the low-pressure state and the amount of time that the fuel injection valve 2 is open becomes longer, the fuel pressure in the high-pressure fuel pipe 15 declines (times t5 to t6), and it ultimately converges on the pressure of the combustion chamber 3, and then does not fall below there (times t6 to t7).

Further, when the fuel injection valve 2 closes (time t7), since the communication of the combustion chamber 3 and the high-pressure fuel pipe 15 is blocked, the fuel is supplied to the high-pressure fuel pipe 15, and the pressure in the high-pressure fuel pipe 15 returns again to equal to or greater than the regulator pressure of the low-pressure fuel pump 10 (times t7 to t8).

When the fuel injection valve (the pressure release valve) 2 opens, and when the pressure in the high-pressure fuel pipe 15 and the pressure (approximately atmospheric pressure) in the combustion chamber 3 are equalized (times t6 to t7), the internal pressure of the combustion chamber 3 is used as the reference pressure (3E) and the fuel pressure sensor correction means 17E in the control unit 17 corrects the characteristic of the fuel pressure sensor 18, and stores the correction value in the memory that is built into the control unit 17.

Note that, for the reference pressure, it is preferable to use a detected value from an cylinder internal pressure sensor (not shown in the diagram) which directly detects the pressure in the combustion chamber 3, or an atmospheric pressure sensor (not shown in the diagram). The reference pressure may also be an estimated value calculated by the control unit 17, or an approximate value that is determined in advance.

Figure 8:
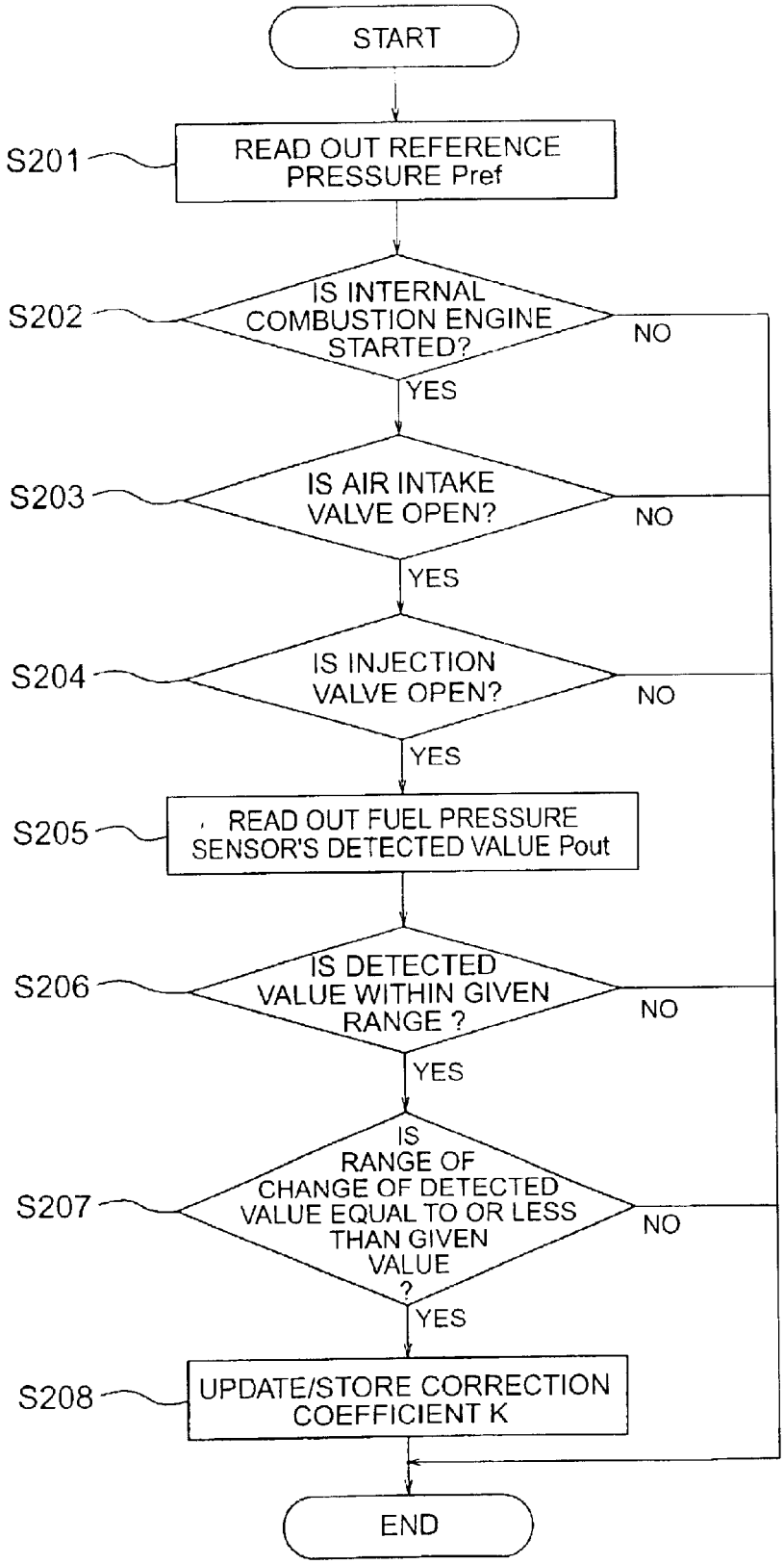
FIG. 8 is a flow chart illustrating operation of fuel pressure sensor correction means according to Embodiment 2 of the present invention.

Next, an explanation will be made regarding operation of fuel pressure sensor correction means according to Embodiment 2 of the present invention. FIG. 8 is a flow chart showing an operation of the fuel pressure sensor correction means according to Embodiment 2 of the present invention.

In FIG. 8, the reference pressure Pref is read (at this point, it is temporarily assumed that 0 Mpa=atmospheric pressure, and 0 Mpa is read) (step S201).

Then, it is determined whether or not the internal combustion engine 1 is started (step S202). In the case where it is determined that the internal combustion engine 1 is started (i.e., YES), it is determined whether or not the air intake valve 5 is open (step S203). On the other hand, in the case where the internal combustion engine 1 is stopped (i.e., NO), the procedure skips steps S203 to S208, and the processing routine in FIG. 8 ends.

At step S203, in the case where the air intake valve 5 is open (i.e., YES), it is determined whether or not the fuel injection valve 2 is open (step S204). On the other hand, in the case where the air intake valve 5 is closed (i.e., NO), the procedure skips steps S204 to S208, and the processing routine in FIG. 8 ends.

At step S204, in the case where the fuel injection valve 2 is open (i.e., YES), the detected value Pout of the fuel pressure sensor 18 is read (step S205). On the other hand, in the case where the fuel injection valve 2 is closed (i.e., NO), the procedure skips steps S205 to S208, and the processing routine in FIG. 8 ends.

Next, it is determined whether or not the detected value Pout of the fuel pressure sensor 18 which was read is within the given range (PL≦Pout≦PH) (step S206).

At step S206, in the case where the detected value Pout of the fuel pressure sensor 18 is within the given range (i.e., YES), the procedure advances to step S207. On the other hand, in the case where it is not within the given range (i.e., NO), the procedure skips steps S207 to S208, and the processing routine in FIG. 8 ends.

At step S207, it is determined whether or not the rate of change between, for example, the previous detected value Pout (i−1), and the current detected value Pout (i), is a given value or less at the fuel pressure sensor 18 from which the detected value was read.

For example, as shown in a formula (4) below, a determination is made as to whether a difference per unit time between the previous detected value Pout (i−I) and the current detected value Pout (i) is a given value Pa or less.

$$|Pout(i)-Pout(i-1)|/\Delta t \leqq Pa \quad (4)$$

At step S207, in the case where the rate of change of the detected value Pout from the fuel pressure sensor 18 is the given value Pa or less (i.e., YES), the correction coefficient K for the fuel pressure sensor 18 is calculated using the formula (2), the correction coefficient K in the memory of the control unit 17 is updated, the coefficient is stored into the memory (step S208), and the processing routine in FIG. 8 ends.

On the other hand, in the case where the rate of change of the detected value Pout of the fuel pressure sensor 18 is greater than the given value Pa (i.e., NO), the process skips step S208, and the processing routine in FIG. 8 ends.

Thereinafter, using the formula (3), the control unit 17 uses the correction coefficient K stored in the memory to correct the detected value from the fuel pressure sensor 18.

Note that, the correction coefficient K is set at "0" as an initialized value at the time when the battery is first connected to the control unit 17. Subsequently, this is updated by the present processing routine, and the value stored by the present processing routine is used until the battery is removed form the control unit 17.

As described above, the characteristic of the fuel pressure sensor 18 is corrected at the time when the fuel pressure in the high-pressure fuel pipe 15 is equal to the atmospheric pressure, which is the internal pressure of the combustion chamber 3. Therefore, the fuel injection valve 2 can be used as the pressure release valve just as it is, thus enabling construction of a low-cost system without changing the conventional construction and without adding special new parts.

Further, the characteristic of the fuel pressure sensor 18 should exhibit variation within the range between the upper and lower specification limits, as described above (see FIG. 4). In the case where the it has drifted away from the reference pressure out of the upper or lower specification limits, it is understood that there is some sort of abnormality in the system. Therefore, in such a situation, there is a danger of the erroneous correction occurring.

Therefore, the erroneous correction is prevented by correcting the fuel pressure sensor characteristic only when the detected value from the fuel pressure sensor 18 is within the given range.

Further, in the state where the absolute value of the detected value from the fuel pressure sensor 18 is not stable, there is also a danger that the correction of the characteristic of the fuel pressure sensor 18 will be an erroneous correction. Therefore, the erroneous correction can be prevented by correcting the characteristic of the fuel pressure sensor 18 at the time when the rate of change of the detected value from the fuel pressure sensor 18 is a given value or less, which is to say when the detected value from the fuel pressure sensor 18 is sufficiently equal to the internal pressure of the combustion chamber 3.

Embodiment 3

Note that, in Embodiment 1, the pressure of the gas whose pressure is known is used as the reference to correct the detected value from the fuel pressure sensor 18. However, it is also possible to calculate the correction value when a detected value is produced which is impossible in the actual usage environment.

In FIG. 4 described above, the standard characteristic for the fuel pressure sensor 18 is indicated by the graph of the product having the mid-range characteristic, and the relationship between the output electrical voltage Vout and the detected pressure Pf is represented with the formula (1).

In the case where the characteristic of the fuel pressure sensor 18 goes below to the characteristic of the product of the lower specification limit, even if, for example, the atmospheric pressure is applied, the value of the outputted electrical voltage Vout from the fuel pressure sensor 18 will be "VL". Therefore, the detected pressure Pf becomes "PL" (where PL<atmospheric pressure). Thus, in the case where the fuel pressure sensor 18 exhibits variation toward the lower limit, the detected value will indicate a smaller value than the pressure that is actually applied.

However, in the actual usage environment, even if the fuel pressure becomes slightly the atmospheric pressure or less instantaneously (i.e., toward the negative pressure side) due to a fuel pressure pulsation in the high-pressure fuel pipe 15, it is still impossible for the fuel pressure to constantly be the atmospheric pressure or less, and it is impossible for it to reach a vacuum pressure.

In light of the above-mentioned characteristics, when the smallest detected value from the fuel pressure sensor 18 indicates the fuel pressure value that is the atmospheric pressure or less, it is judged that the fuel pressure sensor 18 is exhibiting variation in the direction of the lower limit.

Therefore, in the case where the detected value from the fuel pressure sensor 18 has indicated the value that is the atmospheric pressure or less, a given pressure (=atmospheric pressure) is used as the reference pressure, and the correction coefficient K for the fuel pressure sensor 18 is calculated using the formula (2), the correction coefficient K in the memory of the control unit 17 is updated and this is stored in the memory.

As a result, when there is great variation in the characteristic toward the lower limit that is exhibited by the fuel pressure sensor 18, this can quickly be corrected to a range that is actually possible.

Note that, when the fuel pressure pulsation in the high-pressure fuel pipe 15 causes the fuel pressure to instantaneously fall to a value equal to or slightly less than the atmospheric pressure and creates the problem of the erroneous correction, approximately 0.1 Mpa of precision error will occur, but when the detected value from the fuel pressure sensor 18 indicates a value that is the vacuum pressure or less (where vacuum pressure<atmospheric pressure), the given pressure (=vacuum pressure) can serve as the reference pressure to calculate the correction coefficient K of the fuel pressure sensor with formula (2).

Figure 9:
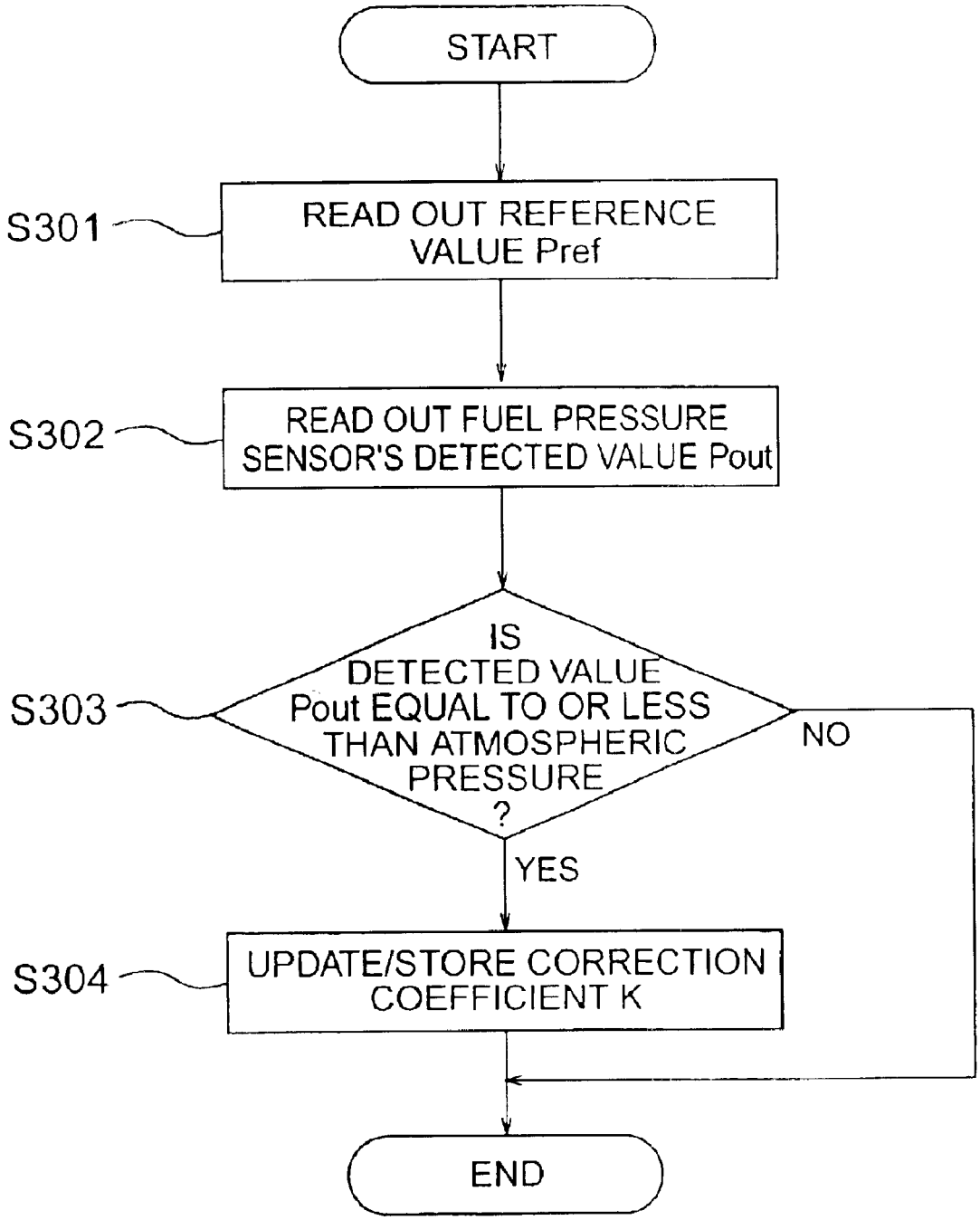
FIG. 9 is a flow chart illustrating operation of fuel pressure sensor correction means according to Embodiment 3 of the present invention.

Next, an explanation will be made regarding operation according to Embodiment 3 of the present invention. FIG. 9 is a flow chart showing operation of a fuel pressure sensor correction means according to Embodiment 3 of the present invention.

In FIG. 8, the reference pressure Pref that has been determined in advance is read (step S301), and the detected value Pout from the fuel pressure sensor 18 is read (step S302).

A determination is made as to whether or not the detected value Pout from the fuel pressure sensor 18 is the atmospheric pressure or lower (step S303).

At step S303, in the case where the detected value Pout is the atmospheric pressure or less (i.e., YES), the correction coefficient K for the fuel pressure sensor 18 is calculated using the formula (2), the correction coefficient K stored in the memory of the control unit 17 is updated and this is stored in the memory (step S304), and the processing routine of FIG. 9 ends.

On the other hand, at step S303, in the case where the detected value Pout is greater than the atmospheric pressure (i.e., NO), the procedure skips step S304, and the processing routine in FIG. 9 ends.

Thereinafter, the correction coefficient K that was updated and stored in the present processing routine is used to correct the detection characteristic of the fuel pressure sensor 18 using the formula (3). Therefore, at least when there is great variation in the characteristic of the fuel pressure sensor 18 toward the lower limit, the detected value can become one which has been quickly corrected back to within the range that is actually possible.

Note that, the correction coefficient K is set at "0" as its initial value at the time when the battery is first connected to the control unit 17. Thereinafter, the correction coefficient K is updated by the present processing routine, and the values stored by the present processing routine are used until the battery is removed from the control unit 17.

As described above, in the range of variation exhibited by the characteristic of the fuel pressure sensor 18, when the fuel pressure sensor 18 indicates a negative pressure which is actually impossible as the detected value, the characteristic of the fuel pressure sensor 18 is immediately corrected to within the actually possible range.

As has been described above, according to the present invention, there is provided the characteristic correction system for a fuel pressure sensor which detects the fuel pressure supplied to a combustion chamber of an internal combustion engine, including a high-pressure fuel pump for sucking up the low-pressure fuel pumped out from a fuel tank and discharging a high-pressure fuel, a high-pressure fuel pipe for accumulating/pressurizing the high-pressure fuel, a fuel pressure control valve for adjusting a fuel pressure of the high-pressure fuel to a given value, a fuel injection valve for directly injecting into the combustion chamber a high-pressure fuel which has been adjusted by the fuel pressure control valve, a pressure release valve for equalizing a pressure in the high-pressure fuel pipe at a known gas pressure, a fuel pressure sensor for detecting the pressure in the pipe, and a control unit for calculating a correction value for a detected value from the fuel pressure sensor, based on a pressure differential between the pressure in the pipe and the gas pressure, wherein the control unit opens the pressure release valve, and when the pressure in the pipe becomes equal to the gas pressure, the gas pressure is used as a reference value to calculate the correction value. Therefore, there is an effect that the characteristic correction system for a fuel pressure sensor is obtained in which it becomes possible to easily and precisely perform the correction in light of the deterioration in the detection precision level arising from the manufacturing tolerance and the deterioration of the fuel pressure sensor and the like.

Further, in accordance with the present invention, the pressure release valve is composed of an electromagnetic valve for communicating the high-pressure fuel pipe and the fuel tank under the control by the control unit, and the control unit releases the pressure release valve, and when the pressure in the pipe and a gas pressure in the fuel tank become equalized with each other, the gas pressure in the fuel tank serves as the reference value to calculate the correction value by the control unit. Since the opening of the pressure release valve allows the fuel that has flown out from the high-pressure fuel pipe to return back into the fuel tank, there is an effect of obtaining a characteristic correction system for a fuel pressure sensor which, in an extremely safe system can easily and accurately achieve the correction which takes into consideration the deterioration of the detection precision in the fuel pressure sensor.

Further, in accordance with the present invention, the control unit calculates the correction value after the supply of the high-pressure fuel from the high-pressure fuel pump to the high-pressure fuel pipe has stopped. Therefore when the pressure release valve is opened in the state where the supply of the fuel has stopped, the fuel pressure in the high-pressure fuel pipe quickly becomes equal to the internal pressure of the fuel tank and stabilizes, and this has an effect of obtaining a characteristic correction system for a fuel pressure sensor in which the correction of the characteristic of the fuel pressure sensor can be carried out quickly.

Further, in accordance with the present invention, the control unit calculates the correction value after a given amount of time or more has passed since the pressure release valve was opened. Therefore, the characteristic of the fuel pressure sensor can be corrected after there has elapsed at least a response time of the pressure in the high-pressure fuel pipe which is necessary for the pressure in the high-pressure fuel pipe and the fuel tank pressure to become sufficiently equal to each other, and this has an effect of obtaining a characteristic correction system for a fuel pressure sensor which can prevent the erroneous correction of the characteristic.

Further, in accordance with the present invention, the control unit calculates the correction value at the time when the detected value from fuel pressure sensor when the pressure in the pipe is equal to the reference value indicates a value that is within a given range which is determined based on a range of variation in the detected value and based on the reference value. This has an effect of obtaining a characteristic correction system for a fuel pressure sensor which can prevent the erroneous correction by performing no correction when the detected value is outside the given range which is considered as the system abnormality.

Further, in accordance with the present invention, the pressure release valve is composed of the fuel injection valve for communicating the high-pressure fuel pipe and the combustion chamber under the control by the control unit, and when the internal combustion engine has been started and the pressure in the pipe has been equalized with a gas pressure in the combustion chamber when an air intake valve of the internal combustion engine is open, the gas pressure in the combustion chamber serves as the reference value to calculate the correction value by the control unit. Therefore, the fuel injection valve can be used as the pressure release valve just as it is, and this has an effect of obtaining a characteristic correction system for a fuel pressure sensor in which a low-cost system can be constructed with the conventional construction as it is, without special additional parts.

Further, in accordance with the present invention, the control unit calculates the correction value when the detected value from the fuel pressure sensor when the pressure in the pipe is equalized with the reference value indicates a value that is within a given range that is determined based on a range of variation exhibited by the detected value, and based on the reference value, and where a rate of change of the detected value is a given value or lower. Therefore, the characteristic can be corrected when the detected value from the fuel pressure sensor is sufficiently equalized with the internal pressure of the combustion chamber, and this produces an effect of obtaining a characteristic correction system for a fuel pressure sensor in which the erroneous correction can be prevented.

Further, according to the present invention, there is provided the characteristic correction system for a fuel pressure sensor which detects the fuel pressure supplied to the combustion chamber of the internal combustion engine, including a high-pressure fuel pump for sucking up low-pressure fuel pumped out from a fuel tank and discharging a high-pressure fuel, a high-pressure fuel pipe for accumulating/pressurizing the high-pressure fuel, a fuel pressure control valve for adjusting a fuel pressure of the high-pressure fuel to a given value, a fuel injection valve for directly injecting into the combustion chamber a high-pressure fuel which has been adjusted by the fuel pressure control valve, a fuel pressure sensor for detecting a pressure in the high-pressure fuel pipe, and a control unit for calculating a correction value for a detected value from the fuel pressure sensor, based on a pressure differential between the pressure in the pipe and the gas pressure, wherein the control unit calculates the correction value in a case where the detected value is equal to or less than a pressure of atmospheric pressure. Therefore, there is an effect that the characteristic correction system for a fuel pressure sensor is obtained in which in the range of characteristic variation exhibited in the fuel pressure sensor, when the detected value from the fuel pressure sensor indicates a negative pressure that is equal to or less than the atmospheric pressure and which is not actually possible, and this produces an effect of obtaining a characteristic correction system for a fuel pressure sensor which immediately correct to a characteristic that is within the range that is actually possible.

What is claimed is:

1. A characteristic correction system for a fuel pressure sensor which detects fuel pressure supplied to a combustion chamber of an internal combustion engine, comprising:

a high-pressure fuel pump for sucking up low-pressure fuel pumped out from a fuel tank and discharging a high-pressure fuel;

a high-pressure fuel pipe for accumulating/pressurizing said high-pressure fuel;

a fuel pressure control valve for adjusting a fuel pressure of said high-pressure fuel to a given value;

a fuel injection valve for directly injecting into said combustion chamber a high-pressure fuel which has been adjusted by said fuel pressure control valve;

pressure release means for equalizing a pressure in said high-pressure fuel pipe at a known gas pressure;

a fuel pressure sensor for detecting said pressure in said high-pressure fuel pipe; and a control unit for calculating a correction value for a detected value from said fuel pressure sensor, based on a pressure differential between said pressure in said high-pressure fuel pipe and said gas pressure, wherein said control unit opens said pressure release means, and when said pressure in said high-pressure fuel pipe becomes equal to said gas pressure, said gas pressure is used as a reference value to calculate said correction value.

2. A characteristic correction system for a fuel pressure sensor according to claim 1, wherein:

said pressure release means includes an electromagnetic valve for communicating said high-pressure fuel pipe and said fuel tank under the control by said control unit; and said control unit opens said pressure release means, and when said pressure in said high-pressure fuel pipe is equalized a gas pressure in said fuel tank, said correction value is calculated using said gas pressure of said fuel tank as said reference value.

3. A characteristic correction system for a fuel pressure sensor according to claim 2, wherein said control unit calculates said correction value after supply of said high-pressure fuel from said high-pressure fuel pump to said high-pressure fuel pipe has stopped.

4. A characteristic correction system for a fuel pressure sensor according to claim 2, wherein said control unit calculates said correction value after there has elapsed a given amount of time since said pressure release means was opened.

5. A characteristic correction system for a fuel pressure sensor according to claim 1, wherein said control unit calculates said correction value in a case where said detected value from said fuel pressure sensor when said pressure in said high-pressure fuel pipe is equalized with said reference value indicates a value within a given range determined based on a range of variation exhibited by said detected valve and based on said reference value.

6. A characteristic correction system for a fuel pressure sensor according to claim 1, wherein:

said pressure release means includes said fuel injection valve for communicating said high-pressure fuel pipe and said combustion chamber under the control by said control unit; and when said internal combustion engine has been started and said pressure in said high-pressure fuel pipe has been equalized with a gas pressure in said combustion chamber when an air intake valve of said internal combustion engine is open, said control unit uses said gas pressure in said combustion chamber as said reference value to calculate said correction value.

7. A characteristic correction system for a fuel pressure sensor according to claim 6, wherein said control unit calculates said correction value in a case where said detected value from said fuel pressure sensor when said pressure in said high-pressure fuel pipe is equalized with said reference value indicates a value that is within a given range that is determined based on a range of variation exhibited by said detected value, and based on said reference value and where a rate of change of said detected value is equal to or less than a given value.

8. A characteristic correction system for a fuel pressure sensor which detects fuel pressure supplied to a combustion chamber of an internal combustion engine, comprising:

a high-pressure fuel pump for sucking up low-pressure fuel pumped out from a fuel tank and discharging a high-pressure fuel;

a high-pressure fuel pipe for accumulating/pressurizing said high-pressure fuel, a fuel pressure control valve for adjusting a fuel pressure of said high-pressure fuel to a given value;

a fuel injection valve for directly injecting into said combustion chamber a high-pressure fuel which has been adjusted by said fuel pressure control valve;

a fuel pressure sensor for detecting a pressure in said high-pressure fuel pipe; and a control unit for calculating a correction value for a detected value from said fuel pressure sensor, based on a pressure differential between said pressure in said high-pressure fuel pipe and a target gas pressure, wherein said control unit calculates said correction value in a case where said detected value is equal to or less than a pressure of atmospheric pressure.

9. A characteristic correction system for a fuel pressure sensor which detects fuel pressure supplied to a combustion chamber of an internal combustion engine, comprising:

a high-pressure fuel pump for sucking up low-pressure fuel pumped out from a fuel tank and discharging a high-pressure fuel;

a high-pressure fuel pipe for accumulating/pressurizing said high-pressure fuel, a fuel pressure control valve operable to adjust a fuel pressure of said high-pressure fuel;

a fuel injection valve operable to directly inject into said combustion chamber a high-pressure fuel which has been adjusted by said fuel pressure control means;

a fuel pressure sensor for detecting a pressure in said high-pressure fuel pipe; and a control unit for calculating a correction value for a detected value from said fuel pressure sensor, based on a pressure differential between said pressure in said high-pressure fuel pipe and a target gas pressure, wherein said control unit calculates said correction value in a case where said detected value is equal to or less than a pressure of atmospheric pressure.

10. A characteristic correction system for a fuel pressure sensor according to claim 9, wherein the fuel pressure control valve is further operable to equalize a pressure in said high-pressure fuel pipe to a known gas pressure.

11. A characteristic correction system for a fuel pressure sensor according to claim 9, wherein the fuel injection valve is further operable to equalize a pressure in said high-pressure fuel pipe to a known gas pressure.

* * * * *